US005125475A

United States Patent [19]

Ducharme et al.

[11] Patent Number: 5,125,475

[45] Date of Patent: Jun. 30, 1992

[54] ACOUSTIC CONSTRUCTION PANEL

[75] Inventors: Robert Ducharme, Ste-Anne-de-Bellevue; André Boisvert, St-Leon; Johanne Zinkewich, Verdun; Lucie Laroche, Danville, all of Canada

[73] Assignee: Les Materiaux Cascades Inc., Louisville, Canada

[21] Appl. No.: 564,846

[22] Filed: Aug. 9, 1990

[51] Int. Cl.[5] ..... E04B 1/82

[52] U.S. Cl. ..... 181/284; 181/286; 181/293; 181/294

[58] Field of Search ..... 181/284, 286, 293, 294

[56] References Cited

U.S. PATENT DOCUMENTS

| | | | |
|---|---|---|---|
| 2,668,123 | 2/1954 | Copeland | 181/286 |
| 3,159,236 | 12/1964 | Akerson | 181/293 |
| 3,167,151 | 1/1965 | Jack et al. | 181/284 |
| 4,160,491 | 7/1979 | Matsumoto et al. | 181/284 |

*Primary Examiner*—L. T. Hix
*Assistant Examiner*—Khanh Dang

[57] ABSTRACT

An acoustic construction panel for use in the construction of walls, floors, or ceiling structures to improve the acoustical properties thereof, and a method of making that panel. The panel comprises a composition of natural wood fibers, paper and starch, and is absent of any chemical toxic products. The panel has a minimum thickness of about ¾-inch, and an average density in the range of from about 15-lb/ft$^3$ to 17-lb/ft$^3$. A plurality of cavities are perforated on one surface of the panel to increase the acoustical surface properties of the panel. In the construction of the panel the wood pulp is directed into a holding tank for a predetermined period of time in order to expand the wood fibers, and further in which a composite mixture is produced by introducing into the wood pulp predetermined quantitites of starch and wax.

9 Claims, 6 Drawing Sheets

| COMPRESSION (%) | APPLIED FORCE (lbs/in$^2$) |
|---|---|
| 5 | 9.5 |
| 10 | 24.7 |
| 15 | 45.1 |
| 20 | 73.1 |
| 25 | 108.3 |
| 30 | 156.7 |
| 35 | 213.3 |
| 40 | 282.5 |

| COMPRESSION (%) | APPLIED FORCE (lbs/in$^2$) |
|---|---|
| 5 | 7.7 |
| 10 | 20.2 |
| 15 | 39.0 |
| 20 | 63.6 |
| 25 | 95.8 |
| 30 | 135.6 |
| 35 | 184.3 |
| 40 | 246.7 |

ACOUSTIC CONSTRUCTION PANEL

BACKGROUND OF THE INVENTION

1. Field of Invention

The present invention relates to a novel acoustical construction panel having improved acoustical properties and a method of making same.

2. Description of Prior Art

Various types of acoustical panels are known for use in the construction of walls, floors, and ceilings. It is also known to construct complicated composite structures consisting of laminations of different product layers together with spacer strips to provide air layers therein in order to improve the acoustical properties of such structures. It is also known to imbed products within wall panels to improve the acoustical properties thereof.

SUMMARY OF INVENTION

A feature of the present invention is to provide a new acoustical panel construction and wherein the panel is made from natural wood fibers, paper and starch, and absent of any chemical toxic products, and wherein the panel has an average density in the range from about 15-lb/ft$^3$ to 17-lb/ft$^3$, and further wherein cavities are perforated on one surface of the panel to increase the acoustical surface properties of the panel.

Another feature of the present invention is to provide an acoustic construction panel made from a composite structure of wood pulp, recycled paper, starch and wax, and wherein one surface of the panel is provided with a plurality of cavities perforated therein to increase the acoustical properties of the panel.

Another feature of the present invention is to provide a novel method of producing an acoustic construction panel using natural wood fibers, paper, starch and wax, and wherein the panel has a predetermined density.

According to the above features, from a broad aspect, the present invention provides an acoustic construction panel for use in the construction of wall, floor, or ceiling structures to improve the acoustical properties thereof. The panel comprises a composition of natural wood fibers, paper and starch, and is absent of any chemical toxic products. The panel has a thickness of about ¾-inch and an average density in the range of about from 15-lb/ft$^3$ to 17-lb/ft$^3$. A plurality of cavities are perforated on one surface of the panel to increase the acoustical surface properties of the panel.

According to a further broad aspect of the present invention there is provided a method of making an acoustic construction panel for use in the construction of wall, floor, or ceiling structures to improve the acoustical properties thereof. The method comprises producing wood pulp in a refining apparatus and introducing the wood pulp in a hot water retention tank for a predetermined period of time. A predetermined quantity of paper and starch is added to the pulp in the tank, and the composite mixture is maintained for a further predetermined period of time. The composite mixture is then fed to a forming and drying apparatus where it is formed and dried into a layer which has a predetermined thickness to form flat panels, or sheets. Finally, the panels or sheets are perforated on one side thereof with cavities of predetermined size and depth to enhance the acoustical properties of the panel.

BRIEF DESCRIPTION OF DRAWINGS

A preferred embodiment of the present invention will now be described with reference to the examples thereof, as illustrated in the accompanying drawings, in which.

DESCRIPTION OF PREFERRED EMBODIMENTS

Figure 1:
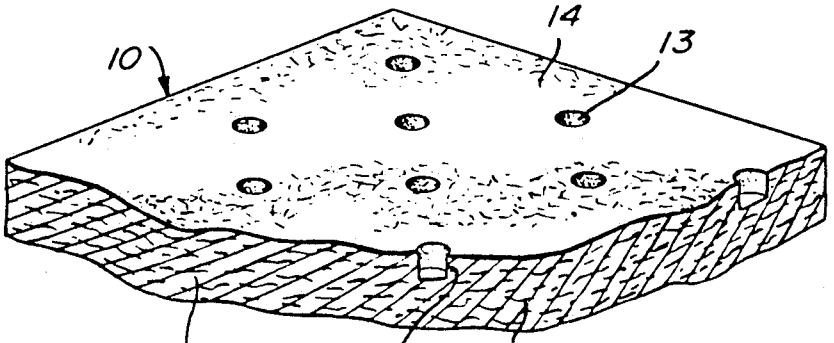
FIG. 1 is a fragmented perspective view of a panel section constructed in accordance with the present invention.
Figure 2:
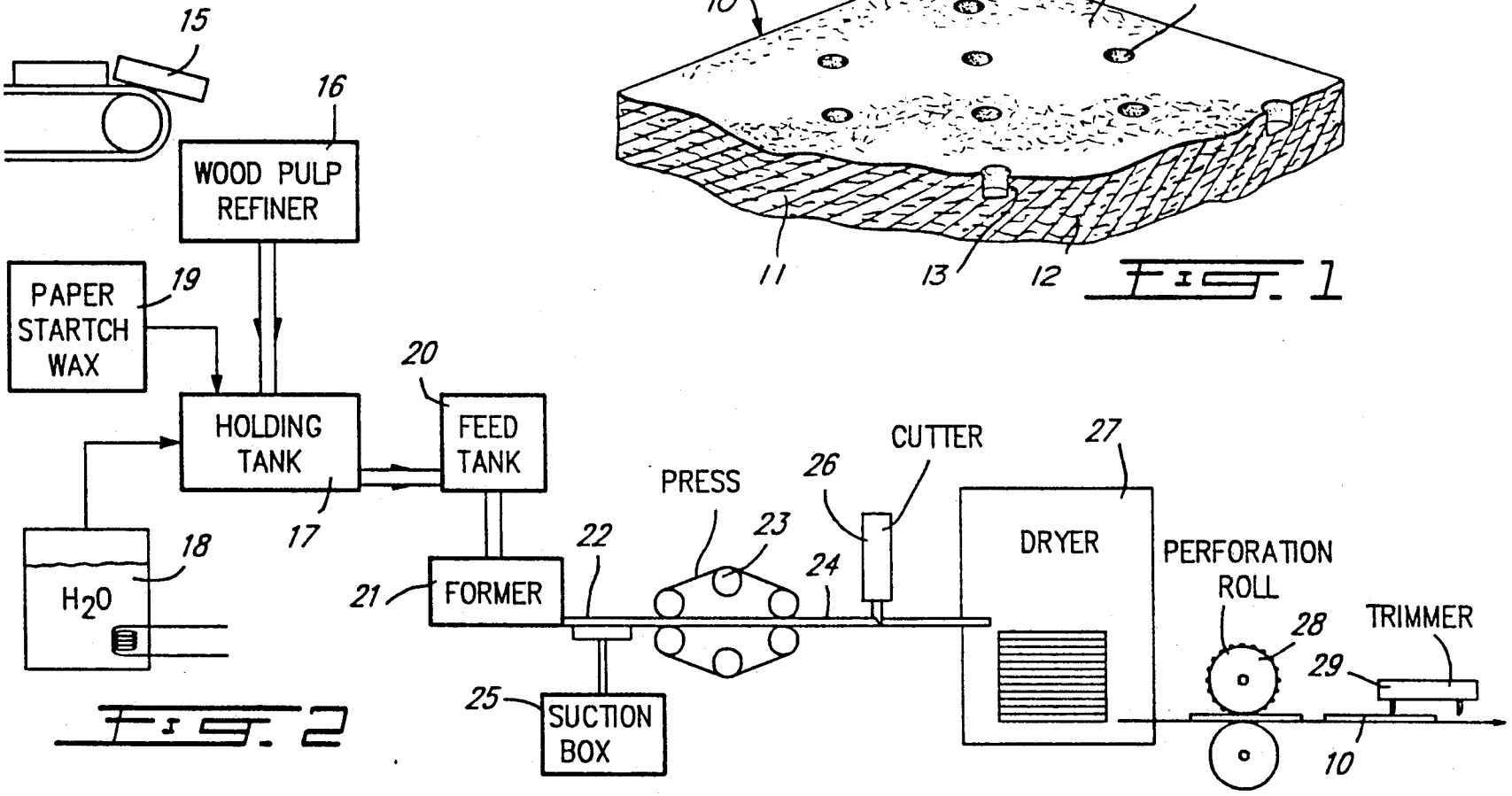
FIG. 2 is a block diagram illustrating the process of making the acoustic panel of the present invention.

Referring now to the drawings, and more particularly to FIGS. 1 and 2, there will be described the construction of the acoustical panel 10 of the present invention. The panel 10 consists essentially of a composite mixture of wood fibers 11 and paper 12 mixed with a predetermined quantity of starch and wax. The panel is formed with an approximate thickness of ¾-inch and the size and density of the panel can vary depending on its intended utility. The panel is also compressed and dried to have an average density in the range from about 15-lb/ft$^3$ to 17-lb/ft$^3$. After the panel has been dried, cavities 13 are perforated on one of its surfaces, herein surface 14. As shown at 13' the cavities are of circular cross-section and extend into the board to a predetermined depth, herein ¼-inch deep which is one-third of the total thickness of the panel 10. The cavities have a diameter of approximately 11/64-inch. With these characteristics the panel has good structural characteristics.

The panel may also be formed by using recycled paper products whereby to reduce the cost of the product, and to provide a use for such paper. Such a panel also has a thermal insulating factor of R2. The cavities 13 are also disposed in parallel rows and offset from one another so that the perforations 13 of adjacent rows are disposed intermediate the perforations in rows on each side thereof.

Referring now more particularly to FIG. 2 there will be described the method of constructing the panel 10 of the present invention. Firstly, wood products, preferably but not exclusively, aspen wood pieces 15 are fed to a wood pulp refiner 16, as is well known in the art, to refine or pulverize the wood pieces into wood pulp. The wood pulp is then transferred into a holding tank 17 into which hot water is fed from a hot water reservoir 18. This wood pulp is retained in the holding tank for a predetermined period of time, herein 15 minutes, so that the wood fibers expand to improve the sound absorption properties of the fibers. Recycled paper, starch and wax is then added to the holding tank and maintained therein to form a composite pulp mixture. The retention time is approximately 45 minutes. A mixture or kneader apparatus (not shown) is provided inside the tank to mix the wood pulp with the paper, starch and wax. For ease of illustration the paper, starch and wax have been shown as coming from a single supply 19, but these may, of course, be supplied independently from one another in a manner well known in the art. After this total residual time of 1 hour, the composite mixture is then fed to a feed tank 20 of a former device 21, which is also well known in the art, to discharge at its outlet a stream or layer of this composite pulp 22.

The composite pulp layer is then fed to pressing rolls or belts 23 and conveyed on a conveyor belt 24 over suction boxes 25 where a predetermined quantity of water is removed from the composite pulp. The pressing belts compress the pulp to a predetermined density. At the outlet of the pressing apparatus a cutter 26 may be positioned to sever the web exiting from the presser into predetermined panel lengths. These panel lengths are then fed into a dryer where they are retained for a predetermined period of time, herein approximately 1 hour and 50 minutes. The dryer may consist of a very large chamber having a conveying apparatus to convey the panels 10 throughout the dryer so that an elapsed time of 1 hour and 50 minutes results between the inlet and output of the dryer. At the outlet 27' of the dryer the boards are fed through a set of perforating rollers 28 where the cavities 13 are formed on one side of the panels 10. Finally, the boards are channeled into a trimmer device 29 to trim the outer edges of the panel to form panels of precise dimensions. The panels are then conveyed to a storage area.

Figures 3A, 3B:
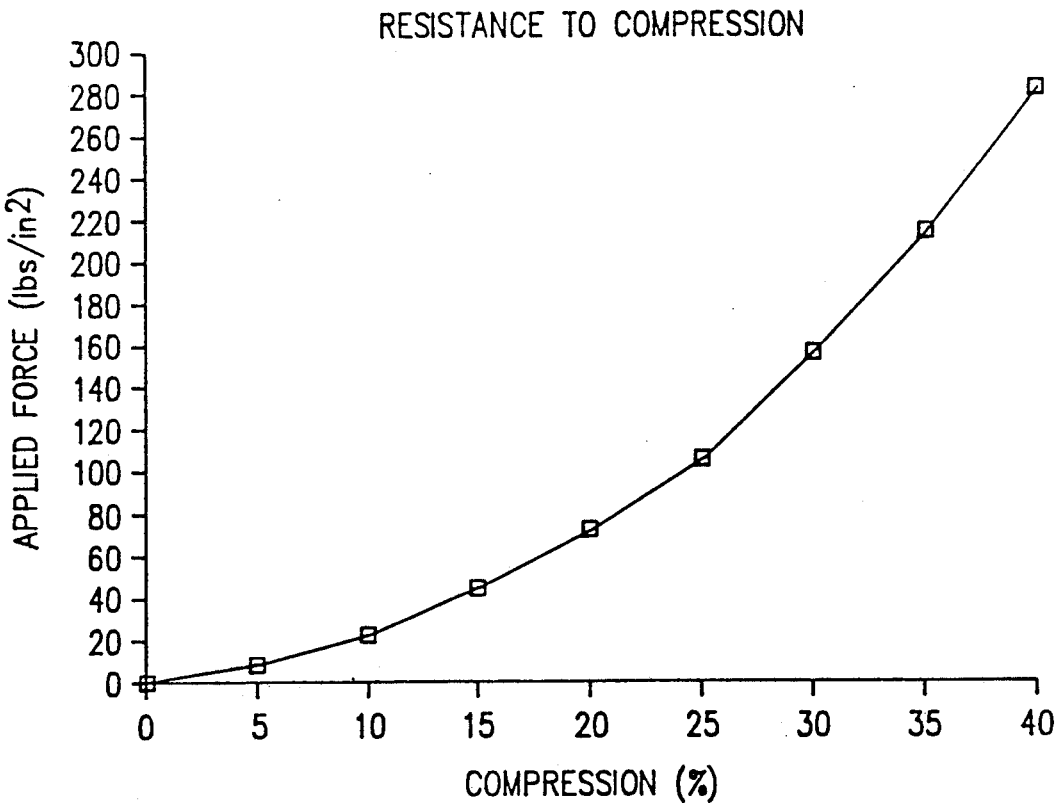
FIG. 3A is a Table illustrating the compression force required to obtain a panel with a predetermined compression characteristic.
FIG. 3B is a characteristic curve illustrating the resistance to compression of the panel.
Figure 5C:
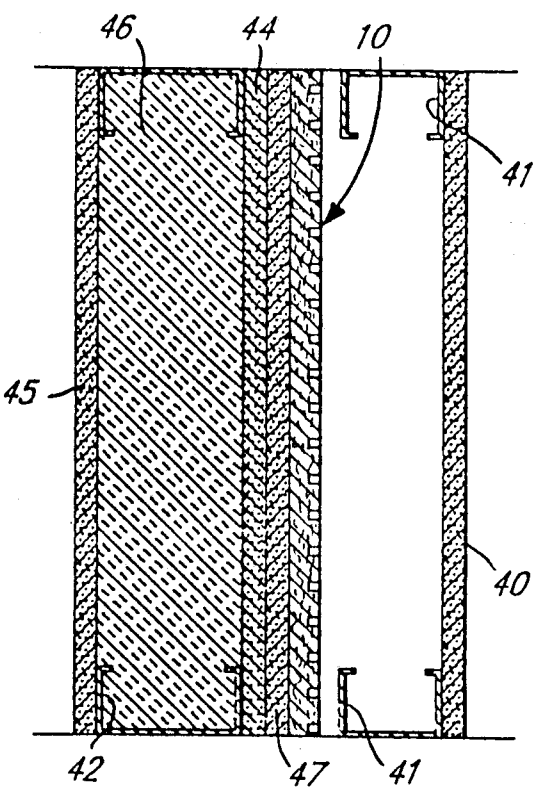
FIGS. 5A to 5D are section views as showing different composite wall, sealing and flooring structures illustrating different utilizations of the acoustic panel of the present invention.
Figure 5B:
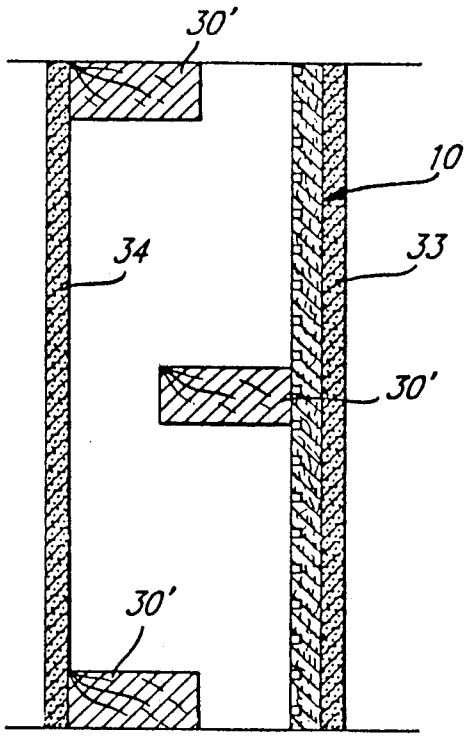
Figure 5A:
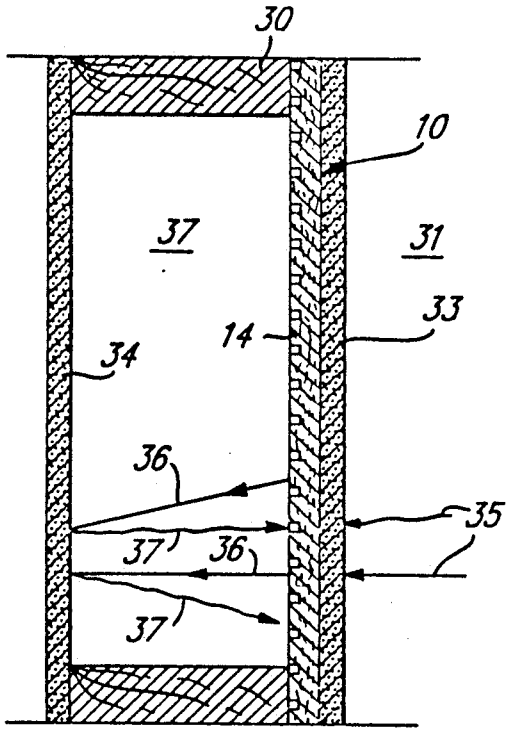
Figure 5D:
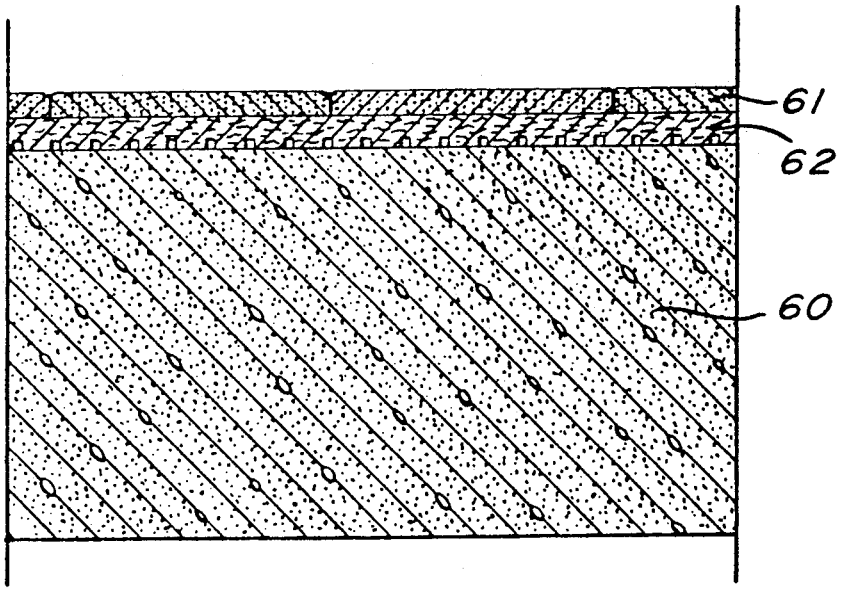

For other applications, such as used between concrete slab 60 and a hard flooring cover 61, see FIG. 5D (i.e. ceramic tiles, marble, etc.) a high impact panel 62 consisting of abour 84% of wood pulp, 10% recycled paper, 4.5% starch, and 1.5% wax, is utilized. This mixture is compressed to produce a panel with a density of 17-lb/ft$^3$. FIGS. 3A and 3B illustrate the compression characteristics of such a panel, and the press belts 23 are adjusted in accordance with these characteristics to obtain the desired product. Such a panel would absorb impact sound generated by walking on hard surfaces. This panel is also used in wall, floor and ceiling structures to absorb airborne sound, such as caused by radio, television, talking, etc., (see FIGS. 5A to 5D).

Figures 4A, 4B:
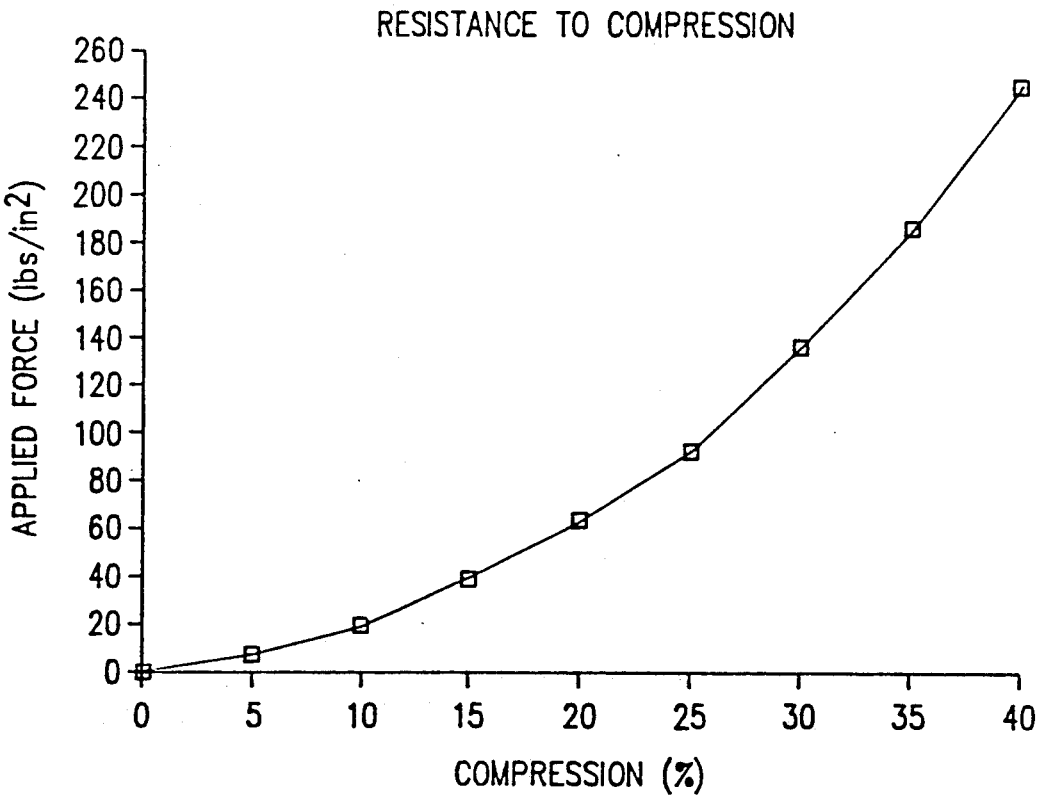
FIG. 4A is a Table similar to FIG. 3A but relating to a panel having a different composition mixture.
FIG. 4B is a characteristic curve similar to FIG. 3B but relating to a panel having a different composite mixture.

When the board is utilized in composite floor or celing structures such board preferably has a density of 15-lb/ft$^3$ and it is constructed from a composite mixture of about 87% wood fibers, 8% recycled paper, 3.5% starch, and 1.5% wax. FIGS. 4A and 4B illsutrate some of the compression characteristics of such a composite mixture.

Referring now to FIGS. 5A to 5C, there is shown cross-sections of various wall constructions utilizing the acoustic construction panel 10 of the present invention. For example, as shown in FIG. 5A, in the construction of a partition wall the acoustic apanel 10 may be positioned against the studs 30 with the perforated surface 14 of he panel 10 facing outwardly of the area or room 31 where sound emanates. The panel is secured to the studs 30 in the normal fashion by utilizing nails or screws. Hard wall gypsum panels 33 are then secured over the acoustic panel 10. On the other side of the stud wall another hard wall panel 34 is secured. Accordingly, the sound waves 35 emanated from the area 31 are somewhat dampened by the hard wall layer 33, and then absorbed by the acoustic panel 10. The residual noise traveling through the composite inner wall structure, as shown by arrows 36, travels through the space 37 between the studs 30 and hits the back wall 34 where it counces off, as illustrated by arrows 37, and back into the surface 14 of the panel. The perforations 13 in the surface increase the surface area thereof and provide further absorption of the recoiled sound waves 37. Accordingly, very little noise penetrates the composite division wall structure, as illustrated herein.

FIG. 5B illustrates a similar structure but wherein the studs 30' are offset to a minimize the physical connection between the composite wall formed by the acoustic panel 10, the hard wall panels 33 and the backing wall 34. This provides an improved sound damping structure.

FIG. 5C shows a still further composite wall structure to improve the acoustical properties of a wall. As herein shown, the composite wall consists of a hard wall or gypsum board 40 held by metal studs 41. The space behind the metal studs 41 is a further metal stud 42 having gypsum boards 43 and 44 on opposed sides thereof and in between which an acoustic product 46 is injected. A further gypsum board 47 may be positioned over the inner board 44, and the acoustic board 10 secured thereover, but spaced from the metal studs 41 in order not to have a connection with the inner gypsum board 40 which is vibrated by the noise emanated in the inner space surrounded by the composite wall structure.

Figure 6A:
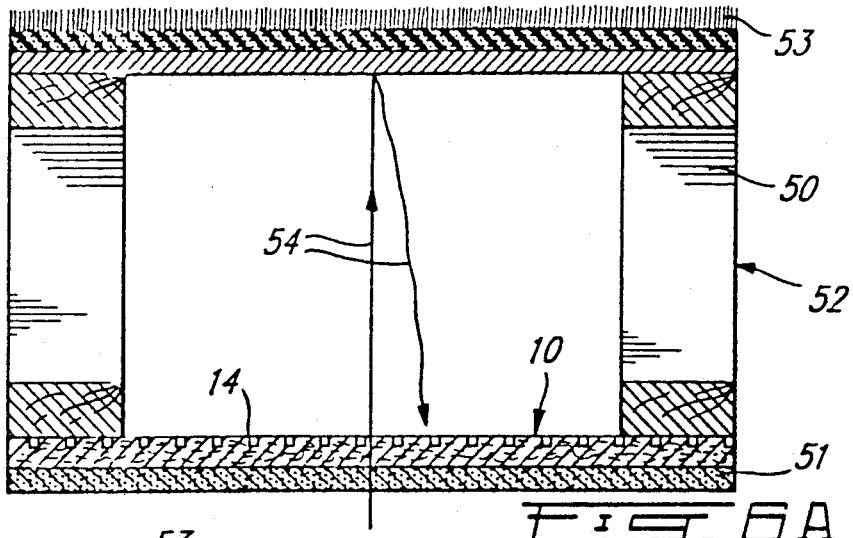
FIGS. 6A to 6C are section views illustrating floor and ceiling structures utilizing the acoustic panel of the present invention.

FIG. 6A illustrates a ceiling structure wherein the acoustic panel 10 is secured to the spacer studs 50. Gypsum board 51 is secured to the acoustic panel 10. The area above the ceiling or floor structure 52 may preferably have a carpet 53 secured thereover to provide further sound damping. Again, the perforated surface 14 of the acoustic panel 10 is located outside the area where the sound wave 54 emanates to provide maximum absorption of that sound wave when passing through the panel and when rebounding from the upper surface of the ceiling structure 52.

Figure 6B:
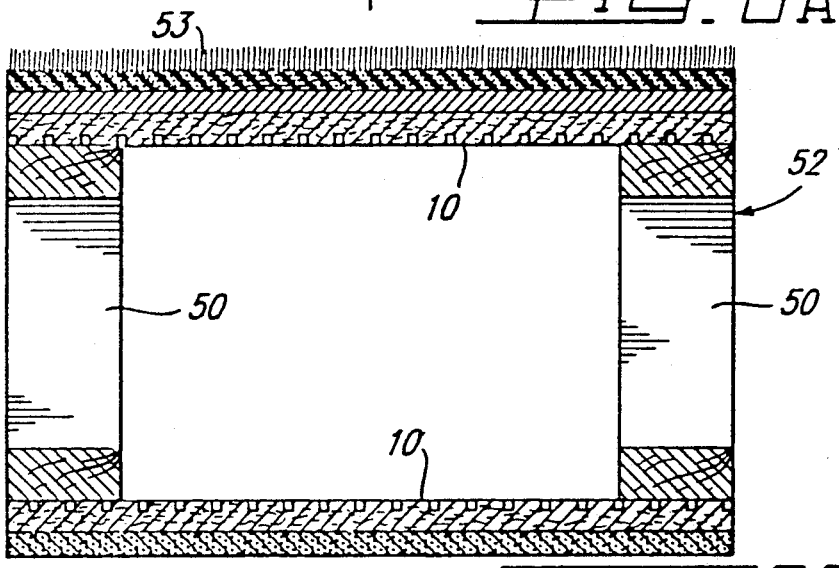
Figure 6C:
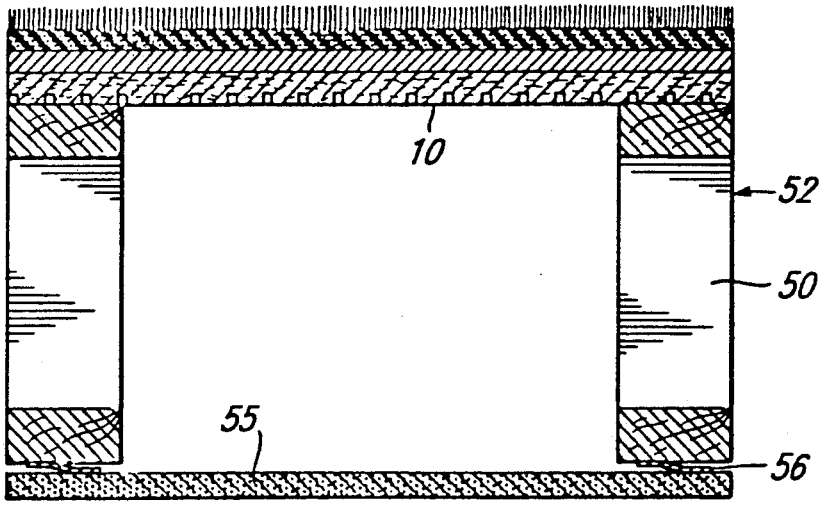

FIGS. 6B and 6C and show other applications of the acoustic panel 10, and as shown in FIG. 6B, two of such panels may be positioned on each side of the spacer studs 50, and again with the perforated surface facing away from the area where around emates. In this particular application there is provided sound damping from both areas below and above the ceiling structure. FIG. 6C shows another embodiment, similar to FIG. 6B but wherein sound absorption is shielded from the upper side of the composite ceiling structure 52. The gypsum board 55 constituting the ceiling in the lower area may also be suspended from the studs 50 by suspension strips 56, as is well known in the art, in order to improve sound damping.

Many other applications and combination of structures are possible utilizing the acoustical construction panel of the present invention. Also, as previously described, the panel may have different sizes depending on its intended use. To achieve its intended sound damping properties and rigidity, it is preferably constructed with the characteristic as above described. However, the wax additive is not essential but is provided to give waterproofing properties to the panels. It is within the gambit of the present invention to cover any obvious modifications thereof, provided such modifications fall within the scope of the appended claims.

We claim:

1. An acoustic construction panel for use with other building surface elements in constructing composite walls, floors, or ceiling structures to improve acoustical properties thereof; said panel comprising a composition of natural expanded wood fibers, paper and starch; said panel having a minimum thickness of about $\frac{3}{4}$-inch and an average density of from about 15-lb/ft$^3$ to 17-lb/ft$^3$, and a plurality of cavities perforated on one surface of said panel, said plurality of cavities being spaced apart perforations of constant cross-section extending entirely throughout said one surface, said perforations extending into said panel to a depth of approximately one-third the thickness of said panel to provide improved acoustical damping of said one surface.

2. An acoustic panel as claimed in claim 1 wherein said composition comprises 87% of said wood fibers, 8% of said paper, 3.5% starch, and 1.5% wax, said wax providing water proofing properties to said panel.

3. An acoustic panel as claimed in claim 1 wherein said paper is comprised of recycled paper products.

4. An acoustic panel as claimed in claim 1 wherein said panel has a thermal insulating R-factor of R2 for said panel thickness of $\frac{3}{4}$-inch.

5. An acoustic panel as claimed in claim 1 wherein said perforations are equidistantly spaced a distance of about $\frac{1}{2}$-inch from one another in parallel rows throughout said one surface, said perforations in adjacent rows being disposed offset and at mid-length between the perforations of said adjacent rows.

6. An acoustic panel as claimed in claim 1 wherein said panel is disposed in said composite walls, floors and ceiling structures with said perforated surface facing outwardly of a room defined thereby.

7. An acoustic panel as claimed in claim 5 wherein at least one further material layer having a solid surface is disposed facing said perforated surface whereby sound waves hitting said solid surface will rebound on said perforated surface.

8. An acoustic panel as claimed in claim 1 wherein said perforations have a diameter of approximately 11/64-inch.

9. An acoustic panel as claimed in claim 2 wherein said wood fibers are aspen wood fibers.

* * * * *